United States Patent [19]

Wurst et al.

[11] 3,987,739

[45] Oct. 26, 1976

[54] SINGLE PATTERN CONTROL OF SEWING MACHINES

[75] Inventors: John Whilldin Wurst, Dover; Robert Conrad Hauf, Upper Montclair; Robert Louis Sedlatschek, Bridgewater; Stephen Alexander Garron, Elizabeth, all of N.J.

[73] Assignee: The Singer Company, New York, N.Y.

[22] Filed: Aug. 7, 1975

[21] Appl. No.: 602,693

[52] U.S. Cl. ..... 112/158 E; 112/219 A

[51] Int. Cl.[2] ..... D05B 3/02

[58] Field of Search ..... 112/158 E, 158 R, 121.11, 112/121.12, 102, 219 A, 67; 235/151.11

[56] References Cited

UNITED STATES PATENTS

| | | | |
|---|---|---|---|
| 3,074,632 | 1/1963 | Braun et al. | 112/121.11 X |
| 3,227,115 | 1/1966 | Bono | 112/219 A X |
| 3,229,654 | 1/1966 | Eguchi | 112/158 R |
| 3,827,381 | 8/1974 | Baanstra et al. | 112/121.11 |
| 3,872,808 | 3/1975 | Wurst | 112/158 E |

*Primary Examiner*—Werner H. Schroeder
*Assistant Examiner*—Peter Nerbun
*Attorney, Agent, or Firm*—Edward L. Bell; Robert E. Smith; Julian Falk

[57] ABSTRACT

In a sewing machine in which any one of a variety of stitch patterns, each of which may have a different number of successive needle penetrations, may be produced repetitively, an operator influenced control is disclosed capable of limiting the operation of the sewing machine to the stitching of a single execution of any selected stitch pattern. After the stitching of the single pattern has been completed, further operation of the sewing machine is inhibited by suspension of needle reciprocation, needle jogging and work feed motion.

5 Claims, 5 Drawing Figures

Fig. 1
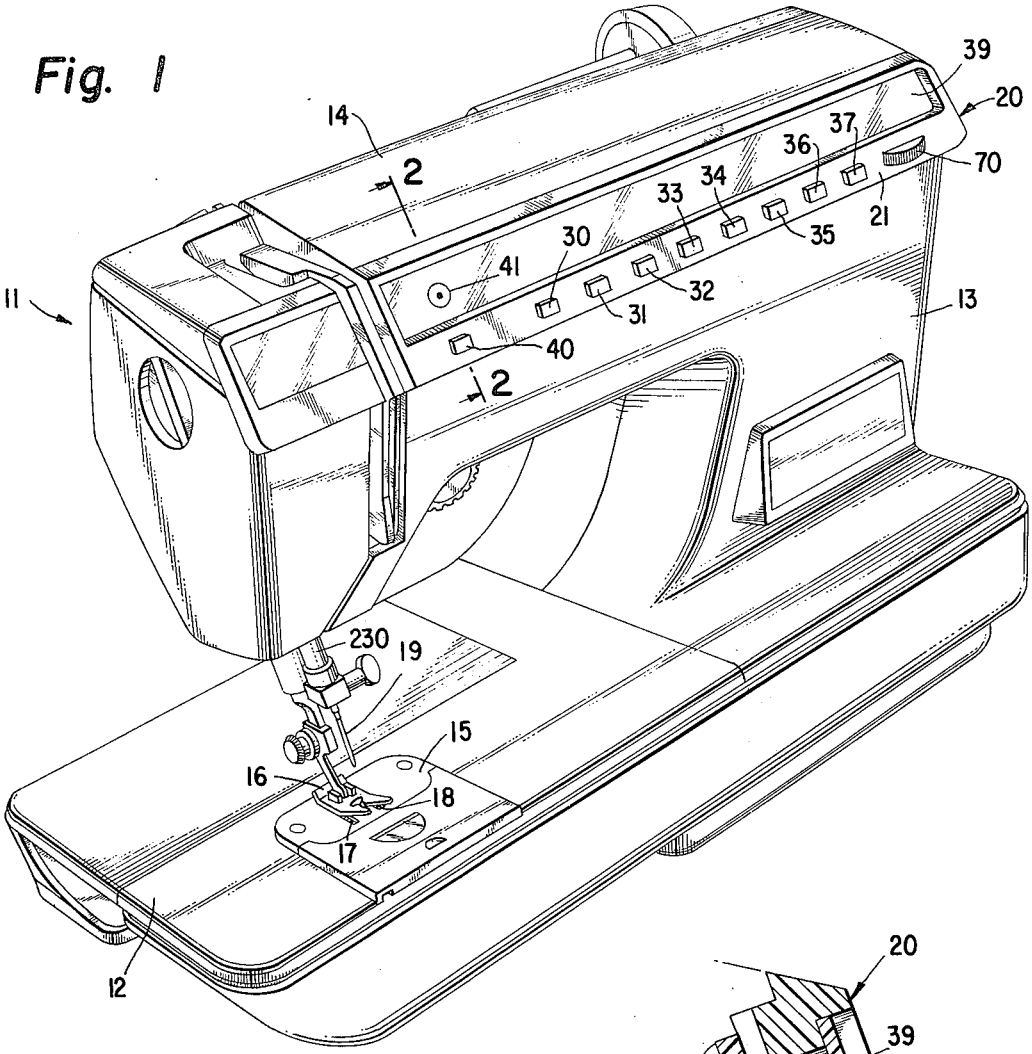
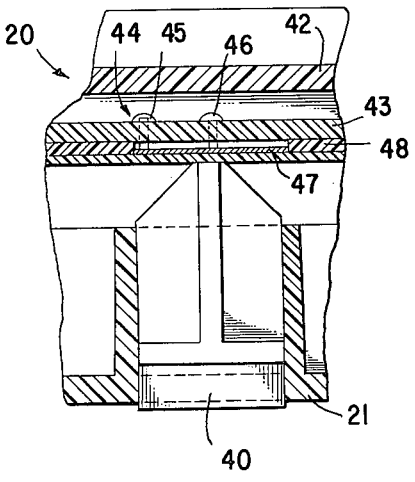
Fig. 3
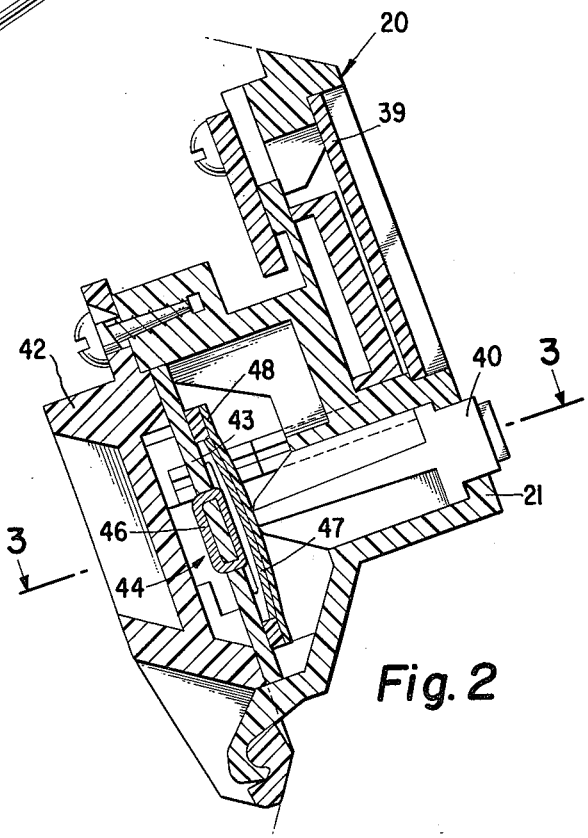
Fig. 2

SINGLE PATTERN CONTROL OF SEWING MACHINES

BACKGROUND OF THE INVENTION

Sewing machines which employ pattern cams for influencing the pattern of successive needle penetrations regularly employ stop motion mechanisms operated by special cam means and effective to stop the actuation of the machine upon completion of each given cycle of cam operation. With these known stop motion devices, the number of stitches which must be formed in each cycle of machine operation is proscribed and, therefore, these known devices would not be appropriate for providing single pattern control for stitch patterns of which the number of stitches may vary for each pattern. Moreover, the forces incident to the operation of the known stop motion devices for abruptly terminating the operation of the sewing machine actuating mechanism require strength and frame rigidity in excess of that which is conveniently available in the usual household sewing machine.

SUMMARY OF THE INVENTION

It is an object of this invention to provide a novel and advantageous arrangement for controlling the production on a sewing machine of a single one of any selected stitch pattern of which the sewing machine is capable of producing.

This object of the invention is attained by including in the stitch pattern information in the sewing machine a means for signaling the end of each stitch pattern which the machine is capable of producing, and by providing on the sewing machine an operator influenced single pattern control which, when rendered effective at any time during the stitching of a pattern, responds to the succeeding end of pattern signal to inhibit further relative movement between the sewing machine needle and the work being stitched.

It is a further object of this invention to provide in a single pattern control arrangement of the above character, alternative means for reestablishing the sewing machine effective to stitch an additional pattern after each inhibition of the sewing machine. This object is attained by the provision of an arrangement in which the sewing machine can be reactivated from the machine inhibit condition by operator influence of either the single pattern control in which case only one additional pattern will be stitched; or by operator influence of the pattern selector control reselecting the particular pattern involved, in which case the pattern will be produced repetitively.

DESCRIPTION OF THE DRAWINGS

The accompanying drawings illustrate a preferred form of this invention in which:

FIG. 1 is a front perspective view of a sewing machine to which this invention has been applied;

FIG. 2 is an enlarged transverse cross-sectional view taken substantially along line 2—2 of FIG. 1 showing the single pattern control switch on the sewing machine;

FIG. 3 is a longitudinal cross-sectional view through the single pattern control switch taken substantially along line 3—3 of FIG. 2;

DESCRIPTION OF THE PREFERRED EMBODIMENT

This invention is adapted to be applied to any sewing machine having an ornamental stitch pattern system operating in response to electronic pattern information signals. The U.S. Pat. No. 3,872,808, Mar. 25, 1975 of John W. Wurst, which discloses one sewing machine of this type is incorporated herein by reference.

Figure 5:
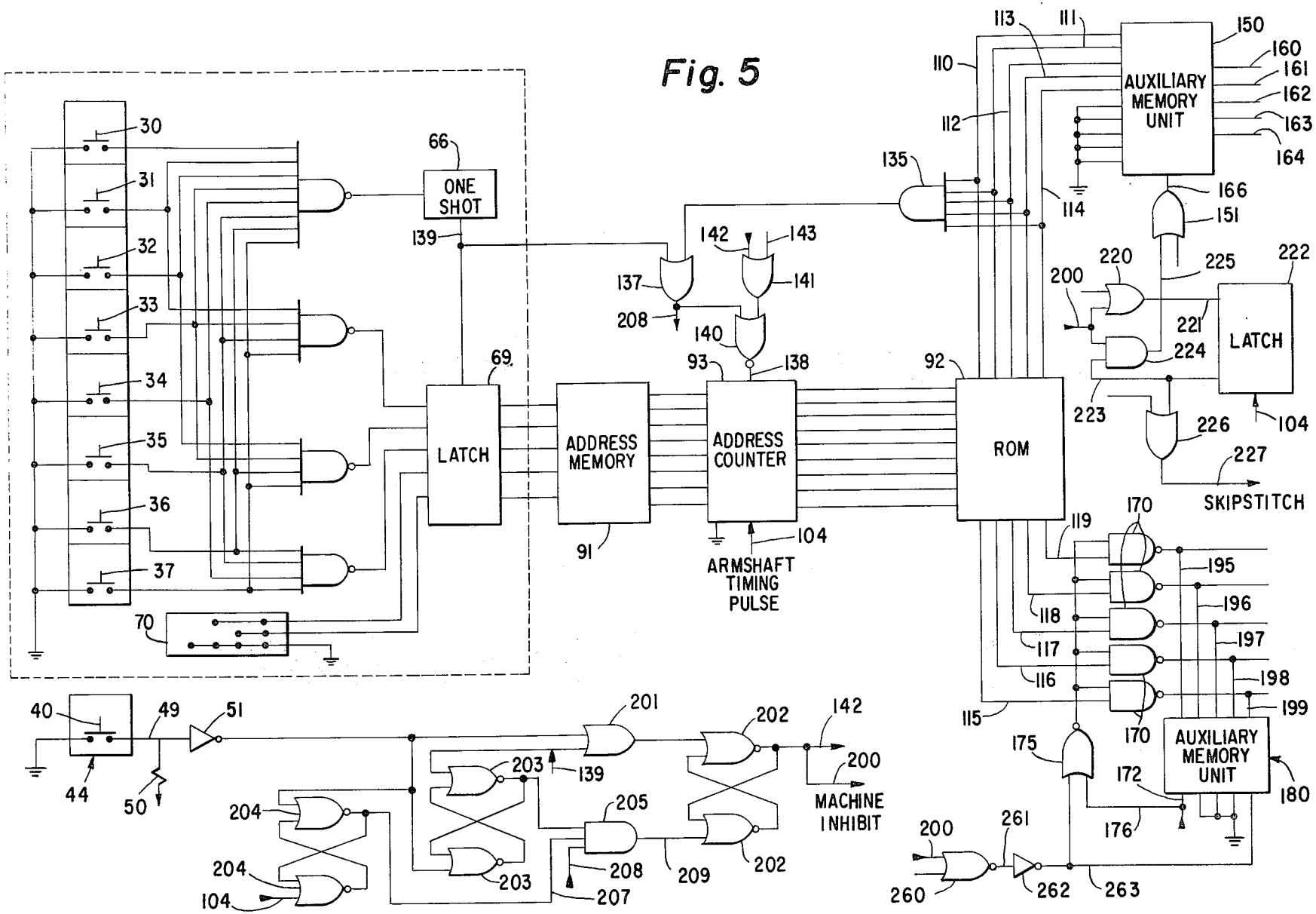
FIG. 5 is a logic diagram showing an ornamental sewing machine stitch pattern system operative in response to electronic signals to which the single pattern control arrangement of this invention is applied.

The logic diagram illustrated in FIG. 5 includes each of the elements disclosed in FIG. 2 of the U.S. Pat. No. 3,872,808, referred to above and in addition, includes additional elements to provide for a greater selection of patterns as well as additional elements in order to provide for the single pattern control arrangement of this invention. Comparison of these figures may assist in an understanding of the present invention.

Referring to FIG. 1 of the drawings, 11 indicates a sewing machine frame including a work supporting bed 12 from which rises a standard 13 which sustains a bracket arm 14 overhanging the bed. A throat plate 15 carried on the bed supports the thrust of a spring loaded presser device 16 carried in the bracket arm. Work fabrics to be stitched are urged by the presser device 16 downwardly against the throat plate and against a work feed dog 17 which works upwardly through slots 18 in the throat plate to feed the work. The throat plate 15 is also apertured to accommodate reciprocation and lateral jogging of a needle 19 carried in the bracket arm.

The bracket arm of the sewing machine is preferably fitted with a control assembly 20 which may be constructed in accordance with that disclosed in the U.S. Pat. application Ser. No. 527,314, of Adams, et al, filed Nov. 26, 1974 which is incorporated herein by reference. Preferably, the control assembly includes an escutcheon plate 21 through which a plurality of pattern selection buttons 30 to 37 protrude, and a transparent insert 39 through which indicia in close association with the selector buttons is visible. An additional button 40 is provided shiftably supported to protrude through the escutcheon plate 21 for the purpose of manually controlling the execution by the sewing machine of only one instance of the selected stitch pattern. Suitable indicia 41 may be arranged on the transparent insert above the single pattern control button to identify the purpose of this element for a machine operator.

Referring to FIGS. 2 and 3, which illustrate in greater detail the single pattern control button 40, and the elements associated therewith, it will be apparent that a closure member 42 is secured to the back of the escutcheon plate 21 and a switch base plate 43 is constrained therebetween. Carried on the switch base plate in alignment with the single pattern control button 40 is an electric switch 44 preferably comprising a pair of contacts 45 and 46 extending through the base plate and covered by a dished shaped electric conducting resilient disc 47. The disc is mounted on a support strip 48 arranged to abut the base plate. The rim of the disc is constantly in engagement with the contact 45 but when uninfluenced by depression of the button 40, the disc 47 remains bowed and out of engagement at the center with the contact 46 as shown in FIG. 2. When depressed by contact of the button, the disc 47 snaps into a position closing an electrically conductive path between the contacts 45, 46 as shown in FIG. 3. Leads including an electrically conductive lead 49 may be arranged connecting the contacts 45, 46, from a ground and as shown in FIG. 5, to a voltage source 50 and then to an inverter 51. When the single pattern control switch is closed, a low or 0 signal will appear on the input side of the inverter 51 and a high or 1 signal will appear at the output side of the inverter 51.

Referring to FIG. 5, the influence on the sewing machine of closure of the single pattern control switch 44 will now be described.

Briefly reviewing those features of the logic diagram of FIG. 5 which remain substantially unchanged from those of the disclosure of U.S. Pat. No. 3,872,808, the pattern selector means 90, depending upon the setting of a switch 70 and depending upon which pattern selection button is depressed, results in appearance of a selected digital code signal continuously on output lines 72, 73, 74, 75 and 76 from the latch 69 and also results in a pulse being generated in the line 139 from the one shot 66. In the address memory 91, the digital code signal on lines 72 to 76 results in an output on lines 80 to 87 which continuously defines the starting word address of a group of consecutive word addresses in the Pattern ROM 92 constituting a stitch pattern. The address counter 93 is responsive to pulses on the line 104 consecutively to increase the address appearing on lines 95 to 103 leading to the ROM 92. In the U.S. Pat. No. 3,872,808, a pulse on the line 138 leading to the address counter was required to reset the counter to the starting word address appearing on lines 80 to 87 and as disclosed in U.S. Pat. No. 3,872,808, this was occasioned either by a pulse in line 139 resulting from selection of a new pattern or upon the appearance of a special end-of-pattern code word on the output lines 110 to 114 from the ROM 92. In the U.S. Pat. No. 3,872,808, the bight output lines 110 to 114 and the feed output lines 115 to 119 from the ROM 92 are shown leading directly to the bight and feed actuating means, respectively.

Referring to FIG. 5, it will be observed that the bight output lines 110 to 114 in the present invention do not lead directly from the pattern ROM 92 to the bight actuating means, but are instead directed to an auxiliary memory unit 150. The auxiliary memory unit 150 stores one pattern of stitch bight information corresponding, for instance, to center needle position, which is applied to output lines 160 to 164 leading to the actuating means whenever a signal is applied to the line 166 leading to the auxiliary memory unit 150. In the absence of a signal on line 166, the auxiliary memory unit 150 will pass to the lines 160 to 164 the stitch pattern information received on lines 110 to 114. The line 166 is directed from the output of an OR gate 151.

The feed output lines 115 to 119 in the present invention similarly are not directly connected to the feed actuating means but instead each includes an open collector in the form of a NAND gate 170. One input of each of the NAND gates 170 is connected to the output of a NOR gate 175.

An auxiliary memory unit 180 is provided capable of influencing on output lines 195 to 199 feed magnitude and direction information of predetermined value in place of the feed control pattern information from the ROM 92. As will be explained hereinbelow, for instance, the auxiliary memory unit 180 is adapted to provide on output lines 195 to 199 feed control signals corresponding to zero feed after the stitching of each single pattern has been completed when the single pattern control is effective.

As shown in FIG. 5, the address counter 93 differs from that disclosed in the U.S. Pat. No. 3,872,808 in that in the present invention a signal, i.e. a high or 1 condition, on line 138 will permit the counter to count, and upon interruption of the signal on line 138, i.e., a low or 0 condition, will cause the counter to reset to whichever beginning of pattern number is continuously impressed thereon by the lines 80 to 87 from the address memory. The AND gate 135 or the OR gate 137 which respond, respectively, to the end-of-pattern signal and to selection of a new pattern, in the present invention, supply input to a NOR gate 140. The output of which is connected to the reset line 138 of the address counter 93.

Another input to the NOR gate 140 is the output of an OR gate 141. A signal appearing at either input to OR gate 141 will cause resetting of the counter. The lead 143 is from a current influenced by means with which the present invention is not concerned. The lead 142, as will be described hereinbelow, is connected to a circuit which responds to initiation of another pattern after any instance of single patterning.

During normal operation of the sewing machine when the single pattern control button 40 is not touched by the operator, the sewing machine will produce continuously repeated stitch groups of whichever pattern of stitches has been selected by actuation of the switch 70 and one of the pattern selector buttons 30 to 37. The selection of any one stitch pattern will operate the latch 69 causing the address memory 91 to output on lines 80 to 87 the address of the first word of the selected pattern in the ROM 92. As the sewing progresses the address counter will consecutively advance from the first word until as explained in U.S. Pat. No. 3,872,808 incorporated herein by reference, an end-of-pattern code word is reached, which for instance, may be the binary code 11111 at the bight output lines 110 to 114. The AND gate 135 will respond to such end-of-pattern code word and by way of OR gates 137 and 140 load or reset the address counter 93 back to the first word of the pattern. By this arrangement, the selected stitch pattern will be repeated continuously.

The operation of the single pattern control system of this invention will now be described.

With reference to FIG. 5, the single pattern control switch 44 is shown connected in a logic circuit of which the output is a machine inhibit signal on line 200. A detailed description will be made hereinbelow as the the sewing machine functions which are influenced by the machine inhibit signal and the manner in which these functions are influenced; suffice it to understand here that the needle reciprocation, needle jogging and work feed motions are suspended. The single pattern control switch 44, therefore, may be closed while either one of two conditions of the circuit obtain, i.e. either while there is or is not a machine inhibit signal on line 200.

When the sewing machine is operating in normal fashion, for instance, during the sewing of any selected pattern, and there is no machine inhibit signal on line 200, momentary closure of the single pattern control switch 44 is blocked by the flip-flop 202 from causing a machine inhibit signal to occur in line 200 even though an OR gate 201 is caused to pass a signal to one side of the flip-flop 202. Moreover, a signal will not be delivered to the line 142 which connects the machine inhibit line 200 with the OR gate 141 in the circuit for loading the address counter. The sewing machine will continue to operate as before for at least one succeeding stitch. Closure of the single pattern control switch 44 under these circumstances causes a signal to be delivered on output line 206 from flip-flop 203 and causes an off condition to obtain on output line 207 from flip-flop 204. On the next succeeding timing pulse from line 104 the flip-flop 204 will be operated causing a signal to be delivered on the output line 207 and thus after one additional stitch formation cycle of the sewing machine an AND gate 205 of three inputs 206, 207 and 208 will have two of its inputs 206 and 207 on in readiness to provide an output on line 209 when next a signal is received on line 208. Such a signal on line 208 will be received when the AND gate 135 provides a signal responsive to the next end-of-pattern code word.

The resulting signal in line 209 will operate the flip-flop 202 causing a signal to be delivered in the machine inhibit line 200.

In addition to maintaining the address counter 93 loaded by way of line 142 as explained above, a signal maintained in the machine inhibit line 200 will be applied as an input to the OR gate 220 of which the output 221 by way of a latch 222 applies a signal to a line 223. A signal appearing on both lines 200 and 223 as input to an AND gate 224 will cause a signal on output line 225 and by way of OR gate 151 a signal on line 166 which as explained earlier will interrupt needle jogging and impose the condition of constant center needle position on the needle jogging mechanism.

Figure 4:
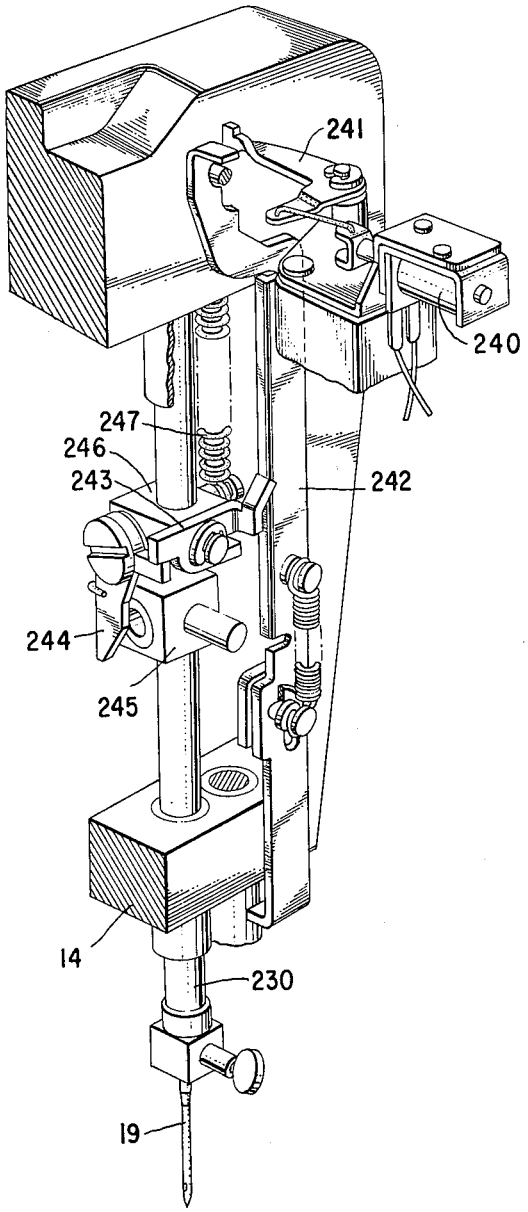
FIG. 4 is a perspective view of the needle bar mechanism in the extremity of the sewing machine bracket arm showing the needle bar release device.

A signal in the line 223 from the latch by way of an OR gate 226 will give rise to a signal in the output line 227 for operating a skip stitch mechanism of the sewing machine. FIG. 4 of the drawings illustrates a skip stitch mechanism which may be utilized in response to a signal on line 227 to interrupt needle reciprocation and cause the needle to assume a raised position. A skip stitch mechanism of the type disclosed in the U.S. Pat. No. 3,872,809, Mar. 25, 1975 which is incorporated herein by reference, may be used. For an understanding of this invention, it will be sufficient to understand that a solenoid 240 actuated upon receipt of a signal in line 227 shifts a mechanical linkage including a bell crank 241, an elongated latch release member 242, and pivoted latch members 243 and 244 which uncouple a needle bar reciprocating block 245 from a collar 246 which is fixed on the needle bar 230. A spring 247 will cause the needle bar to rise to the top of its stroke when the blocks 245 and 246 are uncoupled.

When a signal is caused to occur in the machine inhibit line 200, it is applied as well to one input of a NOR gate 260 resulting in a low or off condition on the output 261 thereof. By way of an inverter 262, a signal will then be delivered on line 263 to the NOR gate 175 turning off the NAND gate open collectors 170 thus interrupting the flow of feed pattern information.

A signal apppearing on line 263 will also influence the auxiliary memory unit 180 to deliver feed pattern signals via lines 195 to 199 corresponding to zero stitch length so that the work feed will be suspended and work fabrics will not be fed while a machine inhibit signal exists in line 200.

When the single pattern control switch 44 is actuated during normal sewing of a pattern, therefore, a delay of one stitch is occasioned so that at least one stitch pattern will follow even if the single pattern switch is closed by coincidence on the last stitch of a pattern. Sewing will then proceed until the last stitch of the selected pattern has been finished following which the needle reciprocation, needle jogging and work feed will be interrupted.

The sewing machine will remain in this inhibited condition, in which operation of the usual actuating mechanism for the stitch forming instrumentalities will not cause stitches to be formed or work transport to occur, until either the single pattern control switch 44 is again depressed or until a pattern is selected by closure of any of the switches 30 to 37.

Upon occurrence of either of these events, the OR gate 201 will be supplied with one input signal either from the inverter 51 or from a pulse occurring on line 139 and a 1 or high condition will be applied to the flip-flop 202. Because of the previous condition of the flip-flop 202, any high signal applied from OR gate 201 will interrupt the machine inhibit signal on line 200. This will influence (1) via a low or off signal on line 142 discontinuance of loading of the address counter 93 so that retrieval of the selected stitch pattern information may proceed from the first stitch of the pattern; (2) By an off condition on one of the inputs to the AND gate 224, discontinuance of the predetermined central needle position by Auxiliary memory unit 150 so that the bight data from the ROM 92 will be delivered to the bight actuation; (3) By an off condition on line 221 and a resulting off condition on line 223 from the latch after the next succeeding timing pulse on line 104 discontinuance of the skip stitch actuation and consequent restablishment of needle reciprocation; and (4) By reversal of the condition of line 263 to a low or off condition, discontinuance of the predetermined zero feed setting by the auxiliary memory unit 180 and by way of NOR gate 175 reversion of the open collector NAND gates 170 to a condition effective to pass the feed data from the ROM 92 to the feed actuator.

If interruption of the machine inhibit signal on line 200 was occasioned by a new pattern selection, the AND gate 205 would not be readied for output upon receipt of a signal on line 208 at the next end-of-pattern code signal and the pattern of stitches would then be repeated ad infinitum. If, however, interruption of the machine inhibit signal resulted from closure of the single pattern control switch 44, the flip-flop 203 and 204 would be operated as described before and at the end of the single pattern, the machine inhibit signal would again be provided as the output of the flip-flop 202.

The single pattern control of this invention is advantageous because it is effective for any one of a variety of stitch patterns each of which may involve a different number of stitches.

Having set forth the nature of this invention, what is claimed herein is:

1. In a sewing machine having stitch forming instrumentalities, including a needle, a loop taker, and a work feeding mechanism, actuating means including connections for endwise reciprocating said needle and for imparting cooperative interrelated movement to said stitch forming instrumentalities for forming a succession of stitches, and stitch patterning means for influencing the individual placement of said succession of stitches in any one of a plurality of different repetitive stitch patterns each of said stitch patterns having an identifiable beginning and last stitch, operator influenced means for at will rendering effective any selected one of said plurality of different stitch patterns, a control system for limiting the operation of said stitch forming instrumentalities to the sewing of only single examples of any selected stitch pattern comprising, means for inhibiting the cooperating interrelated movement of said sewing machine stitch forming instrumentalities by separating from said actuating mechanism said connections for endwise reciprocating said needle, signaling means associated with said stitch patterning means and responsive to the completion of the last stitch of any selected one of said plurality of different stitch patterns prior to the return to the beginning stitch of said stitch pattern, and an operator influenced single pattern control means for rendering operation of the inhibiting means for said stitch forming instrumentalities subject to the next operation of said last stitch signaling means.

2. In a sewing machine as set forth in claim 1 in which said means for inhibiting the cooperative interrelated movement of said sewing machine stitch forming instrumentalites includes means for additionally interrupting lateral jogging of said needle and work transporting motion of said feed mechanism.

3. In a sewing machine as set forth in claim 1 in which said operator influenced single pattern control means includes an electrical switch arranged in a control circuit which in response to momentary closure of said electrical switch is effective thereafter to maintain said inhibiting means subject to the next operation of said last stitch signaling means.

4. In a sewing machine as set forth in claim 1 further including means for delaying for one stitch forming cycle of said sewing machine the effect of operation of said single pattern control means in rendering the inhibiting means subject to the next operation of said last stitch signaling means, and means rendered effective immediately upon operation of said single pattern control means for terminating a previous operation of said inhibiting means.

5. A sewing machine having instrumentalities for forming a succession of stitches individually placed in a selected pattern, said sewing machine including:

a. static memory means in which a multiplicity of separate digital code words are stored in a predetermined sequence with each word corresponding to one individually placed stitch in a pattern;

b. switch means arranged accessible to a sewing machine operator on said sewing machine, and effective to impress on said static memory a signal identifying as a starting word in a pattern a specific one of said multiplicity of separate digital code words which correspond to individually placed stitches;

c. means for providing timing pulses related to the formation of successive stitches formed by said sewing machine;

d. counter means coupled to said static memory means and utiliizing said timing pulses for addressing digital code words in said static memory means in said predetermined sequence beginning with said starting word identified by said switch means signal;

e. last stitch signaling means effective automatically to return said counter to a condition addressing said starting word identified by said switch means signal to repeat said predetermined sequence;

f. actuating means coupled to said static memory means and operatively connected to said stitch forming instrumentalities and responsive to said predetermined sequence of digitally coded words addressed by said counter means for influencing said stitch forming instrumentalities to form a pattern in response thereto;

g. means for inhibiting the operation of said stitch forming instrumentalities, and;

h. a momentary contact single pattern switch means accessible to a sewing machine operator on said sewing machine for rendering operation of said inhibiting means subject to the next operation of said last stitch signaling means.

* * * * *